United States Patent [19]

Mally et al.

[11] Patent Number: 4,645,400

[45] Date of Patent: Feb. 24, 1987

[54] PRODUCT NEATENING SYSTEM

[75] Inventors: Timothy G. Mally, Oregon; Carroll P. Hartl; Daniel L. Orloff, both of Madison; Robert V. Total, Sun Prairie, all of Wis.

[73] Assignee: Oscar Mayer Foods Corp., Madison, Wis.

[21] Appl. No.: 727,649

[22] Filed: Apr. 26, 1985

Related U.S. Application Data

[63] Continuation-in-part of Ser. No. 487,129, Apr. 21, 1983, abandoned.

[51] Int. Cl.[4] ..... B65H 31/40

[52] U.S. Cl. ..... 414/28; 198/404; 271/221; 271/210; 414/786

[58] Field of Search ..... 414/28, 36, 47, 107, 414/786; 198/404, 456, 478.1, 484.1, 803.13; 271/210, 221

[56] References Cited

U.S. PATENT DOCUMENTS

| | | | |
|---|---|---|---|
| 1,586,544 | 6/1926 | White | 271/221 X |
| 2,000,292 | 5/1935 | Miller | 198/404 X |
| 2,565,779 | 8/1951 | Muddiman | 198/404 |
| 2,940,613 | 6/1960 | Prentice et al. | 414/28 X |
| 3,030,867 | 4/1962 | Wright | 414/36 X |
| 3,441,268 | 4/1969 | Hanson | 271/210 |
| 3,795,301 | 3/1974 | Sugitani | 198/404 |
| 3,842,995 | 10/1974 | Dooley | 414/28 |
| 4,344,727 | 8/1982 | Chaloupka | 414/36 |

*Primary Examiner*—Leslie J. Paperner

*Attorney, Agent, or Firm*—Joseph T. Harcarik; Thomas R. Savoie; Daniel J. Donovan

[57] ABSTRACT

An apparatus and method are provided for neatening stacks of thin products, such as sliced luncheon meat, within a processing and packaging operation. The neatening apparatus receives an uneven stack of foodstuff slices that are generally horizontally oriented, and the apparatus reorients the stack of foodstuff slices by rotating them through a generally vertical orientation and to a generally horizontal outfeed orientation. A tamping assembly is adjacent to the reorienting assembly, and the tamping assembly contacts the peripheral edges of the foodstuff slices in order to tamp and shake same to a neatened condition. A generally horizontally oriented outfeed assembly receives the thus neatened stack at the location of generally horizontal outfeed orientation.

6 Claims, 11 Drawing Figures

PRODUCT NEATENING SYSTEM

This application is a continuation-in-part of application, Ser. No. 487,129 filed Apr. 21, 1983 now abandoned.

DESCRIPTION

Background and Description of the Invention

The present invention generally relates to an improved apparatus and method for automatically neatening uneven stacks of foodstuff slices, more particularly for neatening a flow of uneven stacks of foodstuff slices while they are being conveyed along a pathway for insertion into containers for packaging the stacks of foodstuff slices.

Over the years, food processing operations have become increasingly mechanized and automated in an effort to achieve a packaged food product that has a uniform consistency and that has a clean, damage-free appearance which promotes consumer confidence in the product, while at the same time reducing the labor intensity of such processing operations. One foodstuff product that has received considerable attention in this regard is sliced luncheon meat that is packaged as stacks of meat slices. In order to take advantage of economies of scale in these types of operations, the luncheon meat is prepared in large sausage sticks or loaves, and these large products are then loaded onto an automatic slicing apparatus in order to slice and group the luncheon meat into rough stacks of slices which are subsequently packaged. Known slicing machines automatically weigh the slices when they are being cut from the stick or loaf and automatically deposit slice groupings of a desired size or weight onto a conveyor to thereby provide a serial flow of sliced foodstuff stacks.

Traditionally, a meat processor provides a conveyor belt for receiving this flow of stacks of meat slices, whereupon a worker neatens each stack and transfers the neatened stack of meat slices into a packaging container or onto a platter fixture for subsequent formation into a completed package of sliced luncheon meat. Mechanized approaches to performing these functions have also been proposed. Typically, mechanized neatening operations are performed while the foodstuff stacks are generally horizontally oriented, with the individual slices being stacked on top of each other.

When the stacks are horizontally oriented, the weight of each slice bears down upon the slices beneath it in the stack to thereby increase frictional forces between the slices in proportion to the number of slices above same in the stack. Accordingly, any worker or machine that neatens sliced foodstuff stacks must overcome these gravitational and frictional forces which are unevenly distributed throughout each stack, such forces being greater at the bottom of the stack than at the top thereof. On occasion, the procedure or device used to neaten such foodstuff stacks is not adequate to completely neaten the stacks, with the result that some of the stacks are inserted into the package in a somewhat uneven stack. When this occurs, the finally packaged product has an inconsistent appearance, or the product slices can be damaged during packaging. Some such packages must be rejected leading to inefficiency and waste.

Accordingly, there is a need for a system which automatically neatens stacks of foodstuff slices in a sure and consistent manner and that will perform such a function generally irrespective of the extent of slice disarray. Such is accomplished by the present invention wherein a series of uneven stacks of foodstuff slices that are being conveyed in a generally horizontal orientation are reoriented from such generally horizontal orientation, through a vertical orientation and to a generally horizontal outfeed orientation. The reorientation is accomplished by an assembly having stack-receiving outwardly projecting members that rotate generally along a substantially horizontal axis. Preferably, a tamping or shaker assembly is positioned in association with at least the location of vertical orientation, which tamping or shaker assembly contacts portions of the peripheral edges of the stack of foodstuff slices in order to move the slices into neatened alignment with each other.

It is accordingly a general object of the present invention to provide an improved apparatus and method for automatically neatening stacks of sliced foodstuff products.

Another object of the present invention is to provide an improved apparatus and method for receiving a conveyed flow of foodstuff slices which are disposed in uneven stacks and to reorient those slices so as to provide a continuous flow of neatened foodstuff stacks.

Another object of this invention is to provide an improved apparatus and method for receiving conveyed stacks of products from an automatic foodstuff slicer, reorienting those stacks in order to minimize the frictional forces between each slice, and transferring thus neatened stacks in a manner that insures that the stacks will be maintained in their neatened condition.

Another object of the present invention is to provide an improved apparatus and method for neatening stacks of sliced foodstuff which includes tamping the edges of the slices while the stack is generally vertical.

These and other objects of the present invention will become apparent from the following detailed description of this invention, taken in conjunction with the accompanying drawings, wherein.

In accordance with the method and apparatus of this invention, stacks of foodstuff slices are generally horizontally infed to an assembly that rotates about a generally horizontal axis, the rotation reorienting the stack such that each slice is rotated through a generally semi-circular extent during which each slice moves through an orientation at which it is positioned vertically along an edge thereof, at which position each slice is readily movable, and then returned to a horizontal orientation for a smooth and non-disruptive transfer onto a generally horizontal pathway.

The change in orientation of the slices from the infeed horizontal direction to the vertical direction may include contacting the leading edges of the stack with a rigid support member along the generally semi-circular rotational movement location, whereby the leading edges are aligned along the plane of the support member, but the stacks are not necessarily aligned in the direction transverse to the flow of the stacks, which is along the length of each slice. In this instance, and when the slices are in a generally vertical orientation during their rotational movement, the transverse edges of each slice are in general alignment with each other. For example, when the slices are of a rectangular configuration, this latter alignment is of the generally vertical edges of the slices in the stack.

Figure 1:
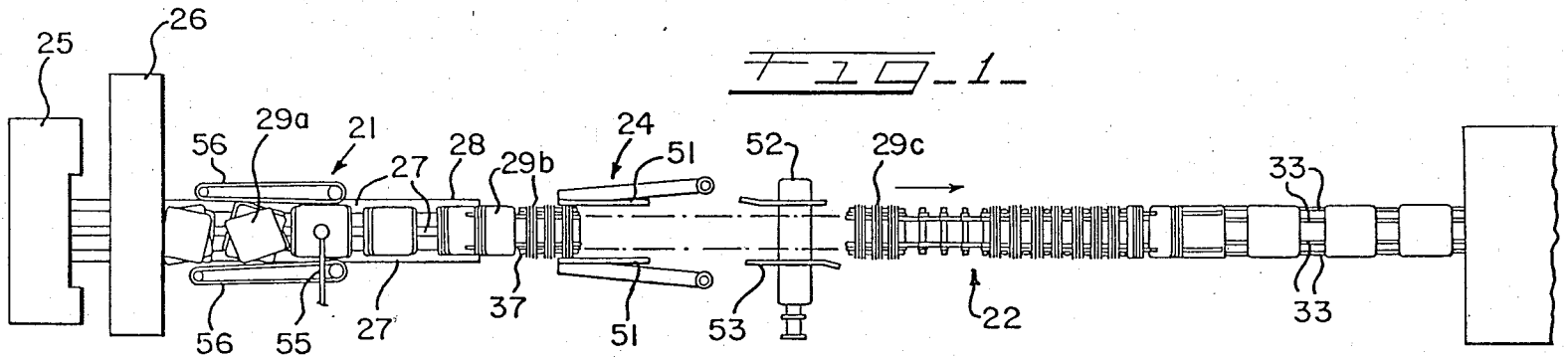
FIG. 1 is a generally schematic plan view illustrating the method and apparatus according to this invention.
Figure 2:
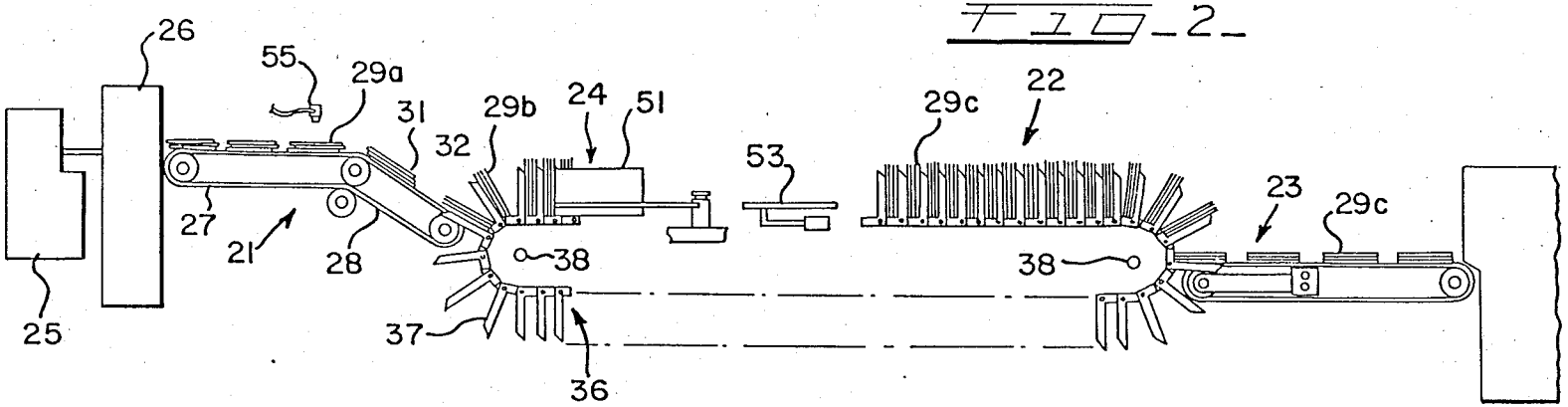
FIG. 2 is a generally schematic elevational view of the invention as it is illustrated in FIG. 1.

As illustrated in FIGS. 1 and 2, the apparatus includes an infeed assembly, generally designated as 21, a reorienting assembly, generally shown at 22, and an outfeed assembly, generally designated as 23. A tamping assembly 24 is also preferably included in general juxtaposition with respect to the reorienting assembly 22. While this combination of assemblies may be for the purpose of, and include structural details relative to, handling a variety of stacks of thin products, the embodiment illustrated herein is preferred for use in connection with handling stacks of sliced foodstuff, most particularly sliced food products such as luncheon meat products that are sliced from elongated sticks or loaves of luncheon meat having round or square cross-sections. A typical slicer 25 is illustrated upstream of the infeed assembly 21. When necessary, a diverter 26 or the like may be included to direct the flow of product stacks from the slicer 25 or the like to the infeed assembly 21.

The infeed assembly 21 typically includes conveying devices such as the illustrated elongated belts 27. In order to facilitate the interchange of uneven product stacks **29*a* from their generally horizontal orientation to a generally vertical orientation, the infeed assembly 21 includes a ramp 28 that projects downwardly into generally meshing interrelationship with the reorienting assembly 22. At about the same time that the uneven stacks 29*a* slide off of the infeed assembly 21 and onto the reorienting assembly 22, the leading edges 31 of the uneven stacks 29*a* engage a rigid support member 32 of the reorienting assembly 22, which engagement partially aligns such leading edges 31 within a plane that generally corresponds to that of the surface of the support member 32 in order to provide initially neatened stacks 29*b*. With square product, the rigid support member 32 establishes a bottom datum plane into which the square slices rotate when they slide down the ramp 28 and fall onto the rigid support member 32**.

Reorienting assembly 22 generally rotates about its axis to move the stack **29*b* generally therealong, which rotational movement includes vertically orienting the stacks 29*b*, at which time each stack 29*b*** becomes easier to neaten than when it was horizontally oriented, each slice of product in the vertical stack resting on the narrow, leading edge thereof, rather than on its face. Neatening is enhanced because no vertically oriented slice lies on top of another vertically oriented slice.

The reorienting assembly 22 includes a plurality of outwardly projecting support tines 37, between which the product stacks are positioned while they are on the reorienting assembly 22. In the arrangements illustrated in FIGS. 1 through 5 and FIG. 9, the support tines 37 form an endless track, generally designated as 36, mounted onto a suitable rotatable shaft or shafts 38. The FIG. 9 embodiment has a circular endless track and a generally semi-circular stack conveyance path. The FIGS. 1 through 5 embodiment has an oval endless track that is an elongated circular endless track having an elongated semi-circular stack conveyor path.

Regarding the tamping assembly 24, it includes a plurality of tamper plates 51 for clapping or tamping the vertically disposed edges of the initially aligned stacks **29*b* so as to form vertically aligned stacks 29*c*. This neatening operation can be assisted by a vibrator assembly 52, which preferably includes vibratory rails 53 for imparting a low amplitude, high frequency impact to the product stacks 29*c* as they move through the vibrator assembly 52. Also, the tamping assembly 24** may include tamper plates which vibrate in order to enhance the effectiveness of their tamping contact with the slices.

At the location of interaction between the reorienting assembly 22 and the outfeed assembly 23, the neatened product stacks **29*c* are rotated from their generally vertical orientation to a generally horizontal outfeed orientation. The tines 37 generally intermesh with endless belts 33 or the like of the outfeed assembly 23 to thereby effect a transfer of the neatened product stacks 29*c* without significantly disrupting same. Preferably, in order to avoid undesirable contact between each neatened product stack 29*c* and the tines 37 immediately trailing it, the outfeed assembly 23 moves at a speed such that the neatened product stacks 29*c* are transported away from the area of intermeshing before the trailing tines 37** enter the intermeshing location.

With more particular reference to the infeed assembly 21, same may include appropriate signal means, such as the illustrated electronic eye assembly 55, to control the reorienting assembly 22 by indicating when a product stack **29*a* is located on the infeed assembly 21. For example, rotation of shaft 38 can be controlled by the signal assembly 55 to the extent that movement of the reorienting assembly 22 will stop at a designated time after the signal assembly 55 indicates the absence of a stack 29*a*. An arrangement of this type is provided when it is desired to ensure that a product stack 29*a* is fed onto each tine 37 when such tines 37 are intermeshed with the infeed assembly 21**.

Infeed assembly 21 may additionally include a rotating side belt pair 56 to initially neaten the product stacks **29*a*. In the preferred arrangement of such side belt pair 56, each belt of the pair moves at a speed that is substantially the same as the speed of the movement of the elongated belts 27 in order to minimize drag on the individual moving slices at the location where they contact the side belt pair 56. Each individual belt of the side belt pair 56** is oriented such that the spacing therebetween is diminished in a gradually tapering manner in the downstream direction.

Figure 3:
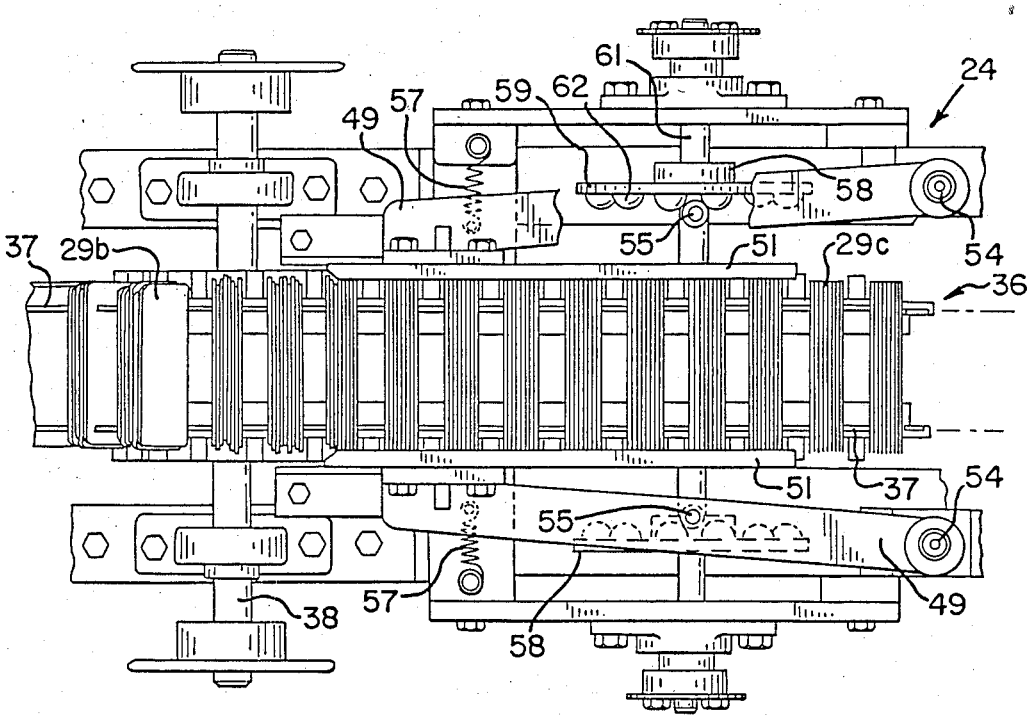
FIG. 3 is a detailed plan view depicting a tamping assembly according to the invention.

Tamping assembly 24 illustrated in FIG. 3 is particularly well-suited for stacks of square product slices, although this assembly 24 also works satisfactorily for stacks of round product slices. In this assembly 24, the tamper plates 51 have generally flat working surfaces for contacting the sides of the individual slices of product stacks 29*b*. Assembly 24 includes arms 49 that pivotally mount the tamper plates 51 along a pivot axis 54. Projecting from each arm 49 is a follower 55. As each follower 55 moves in a generally horizontal direction (up and down in FIG. 3), the arm 49 and the tamper plate 51 mounted thereon likewise move generally horizontally as they oscillate into and out of contact with the stack 29*b*.

A suitable bias member, such as spring 57, urges the plate 51 in a direction generally away from the reorienting assembly 22 and the product stacks 29*b* thereon. Cam assemblies 58 intermittently urge the plates 51 in opposition to the bias members 57 in a direction generally toward the reorienting assembly 22 and the product stacks 29*b*. The illustrated cam assembly 58 includes a disk 59 mounted onto a rotating shaft 61, with a plurality of cam members 62 being generally circumferentially mounted onto the disk 59. As the shaft 61 rotates, the cam members 62 serially engage the follower 55 in order to impart the oscillation or reciprocating movement to the plates 51.

Figure 4:
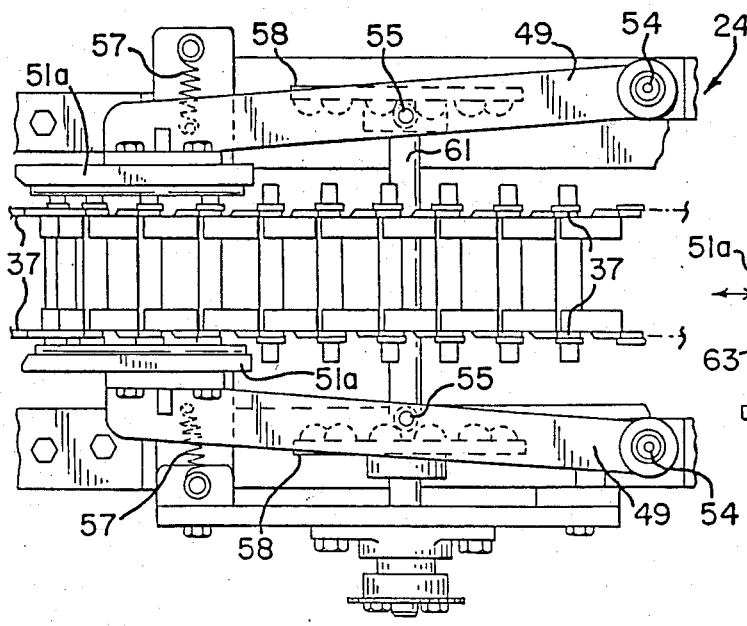
FIG. 4 is a detailed plan view of an alternative tamping assembly for neatening stacks of round foodstuff slices.
Figure 5:
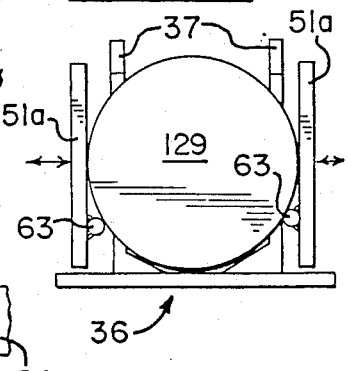
FIG. 5 is an elevational view illustrating the tamping assembly of FIG. 4.

An alternative tamping assembly 24*a* is illustrated in FIGS. 4 and 5. This tamping assembly 24*a* includes tamper plates 51*a* that have inwardly projecting rails 63. Tamping assembly 24*a* is particularly well suited for stacks of round product slices 129. While the tamper plates 51*a* reciprocate or oscillate in a generally horizontal direction, the generally flat working surface of each plate 51*a* contacts the slices 129 at a circumferential location generally along the horizontal diameter of the slice 129. This action imparts a generally horizontal force to the slice 129. At the same time, each rail 63 contacts another location along the circumference of the slice 129, which location is below the area of location between the respective tamper plate 51*a* and the slice 129. More particularly, the engagement location between each rail 63 and slice 129 is along the circumference of the slice 129 between its horizontal diameter and its vertical diameter. Such engagement by the rails 63 imparts a force to the slice 129 that includes a vertical component, as well as a horizontal component, in order to support the slice 129 and lift same as it moves toward the longitudinal center of the reorienting assembly 22, while letting the slice 129 drop as the plate 51*a* moves away therefrom.

Figure 6:
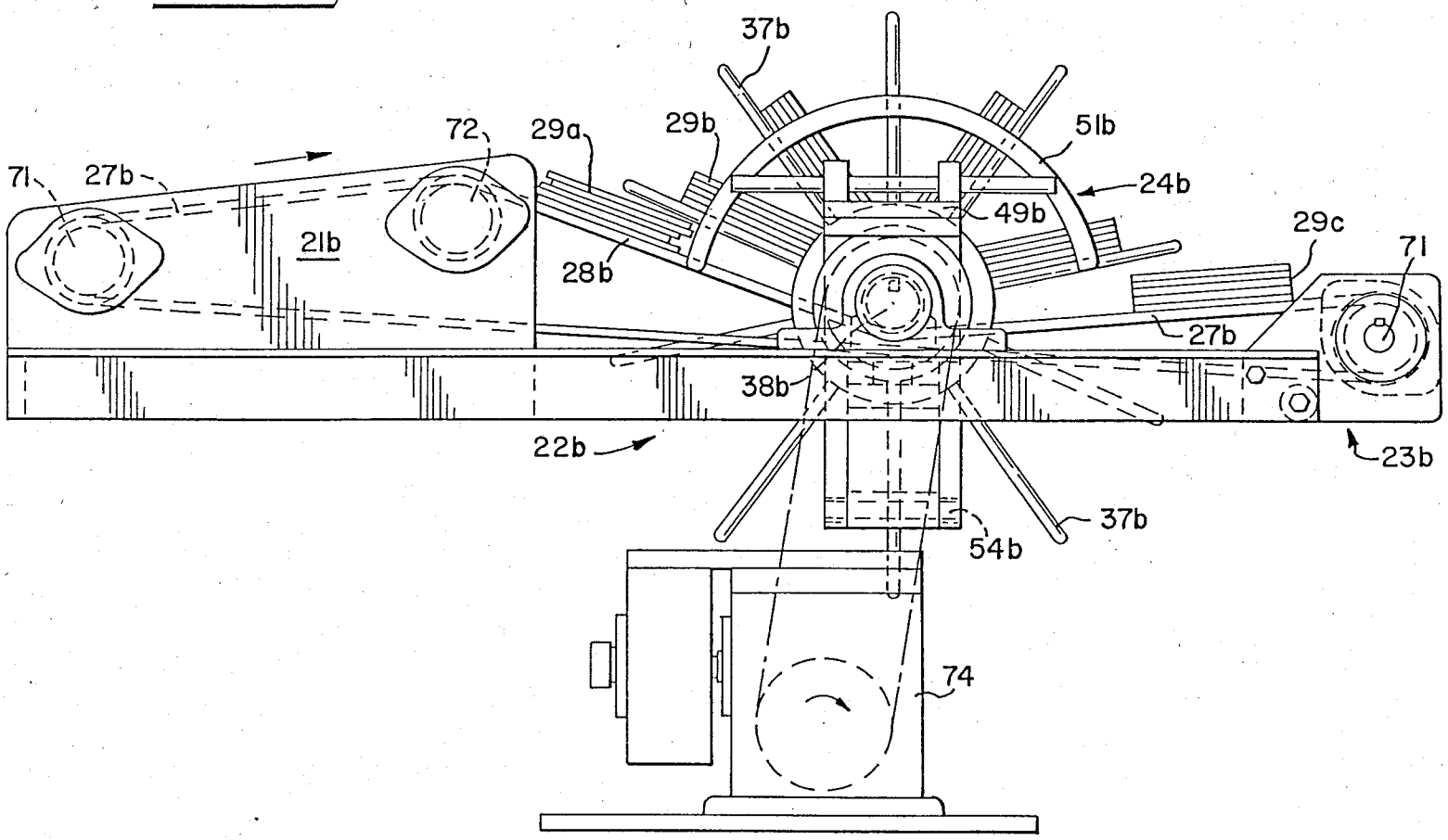
FIG. 6 is an elevational view of an alternative embodiment of a reorienting and tamping assembly.
Figure 7:
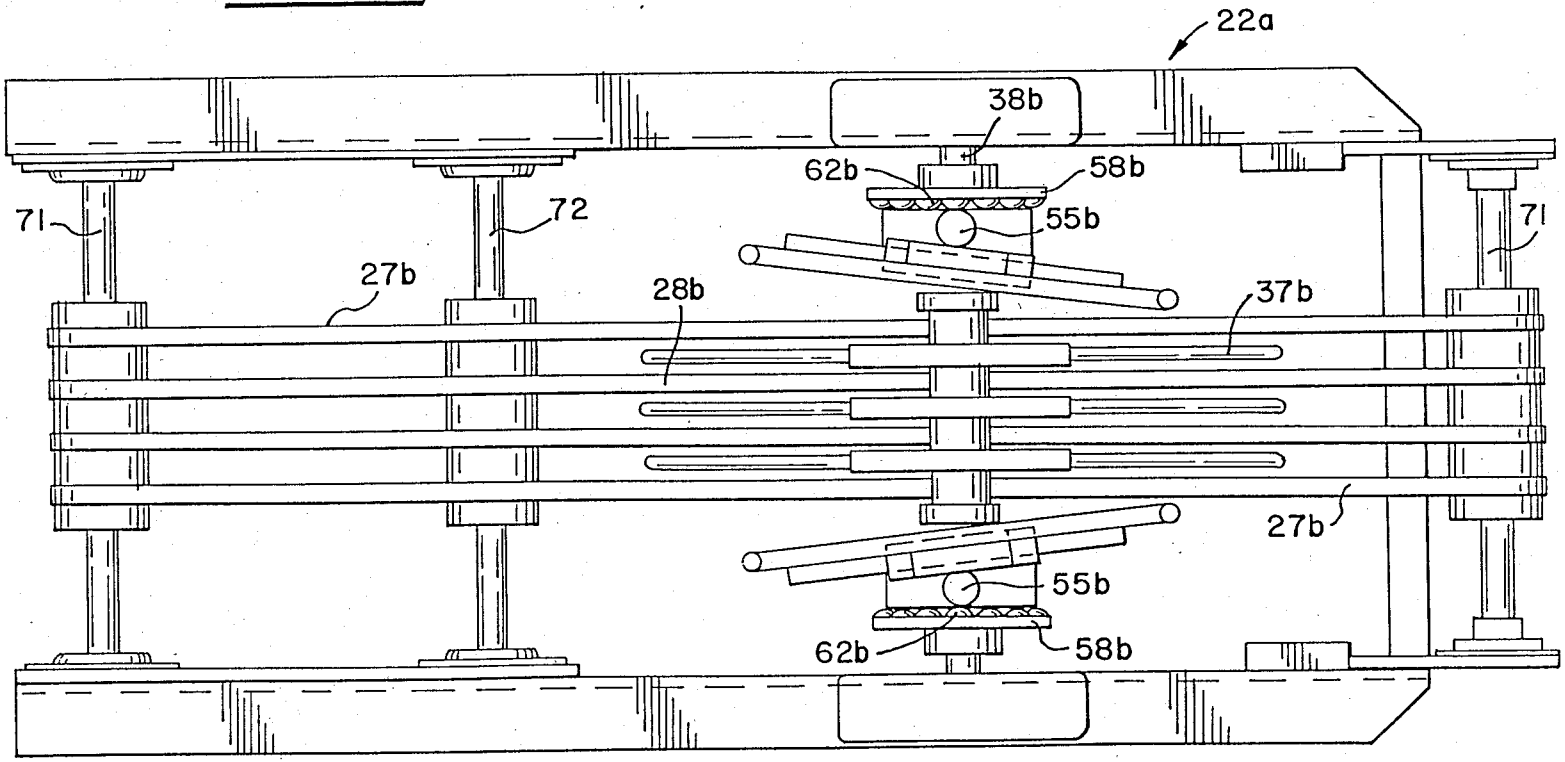
FIG. 7 is a top plan view of the assembly illustrated in FIG. 6.
Figure 8:
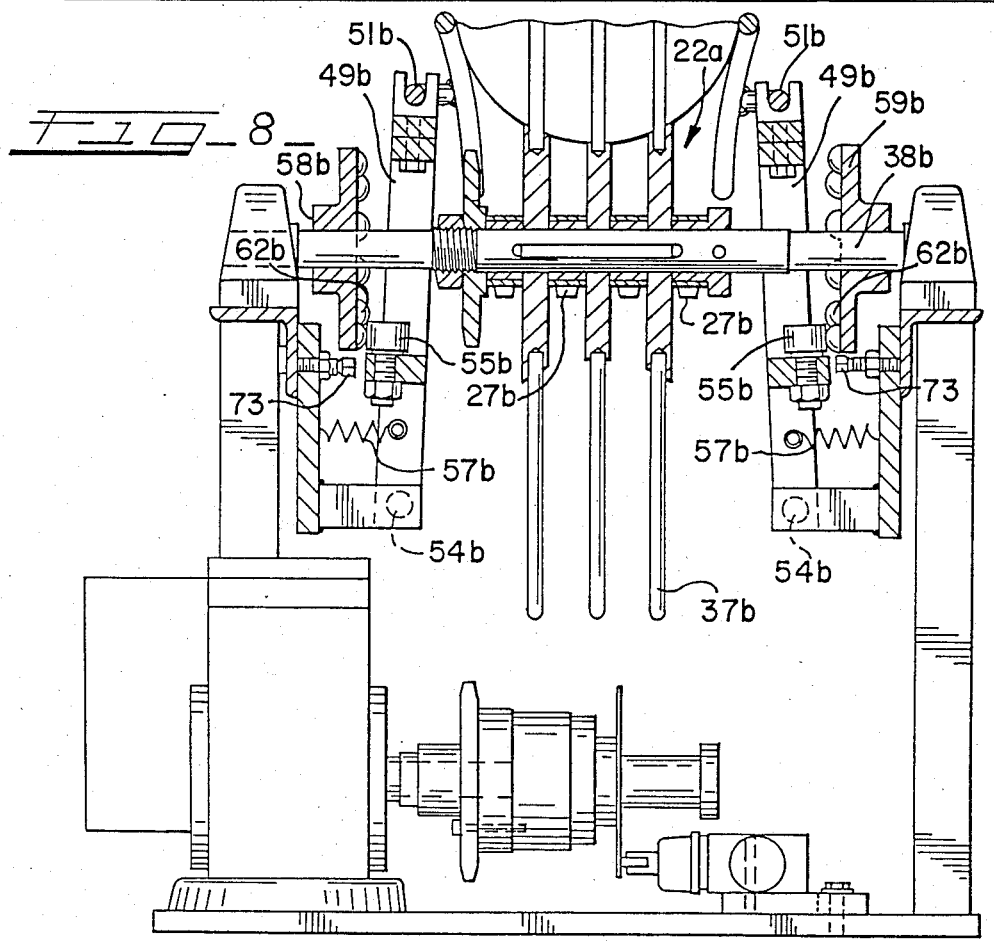
FIG. 8 is a sectional view generally along the rotational axis of the assembly of FIG. 6.

Regarding the neatening system illustrated in FIGS. 6, 7 and 8, such includes an infeed assembly 21*b*, a reorienting assembly 22*b*, an outfeed assembly 23*b* and, preferably, a tamping assembly 24*b*. In this embodiment, the infeed assembly 21*b* and the outfeed assembly 23*b* are interconnected and take the form of a plurality of endless belts 27*b* which rotate between rotatable shafts 71. The infeed assembly 21*b* includes a ramp portion 28*b* which includes a run of the endless belts 27*b* between an elevated rotatable shaft 72 and a rotatable shaft 38*b* of the reorienting assembly 22*b*.

In this embodiment, each support tine 37*b* is mounted in a circumferential arrangement onto the rotatable shaft 38*b*, this embodiment of the reorienting assembly 22*b* bringing about a minimal longitudinal displacement of the stacks 29*a*, 29*b*, 29*c*, as they are manipulated between a generally horizontal orientation, a vertical orientation, and back to a horizontal orientation throughout a generally semi-circular path.

The tamping assembly 24*b* includes a pair of opposing tamper frames 51*b* mounted onto respective tamper arms 49*b*, which are pivotally mounted along a pivot axis 54*b*. A follower 55*b* is mounted onto each of the arms 49*b*. A suitable bias member such as spring 57*b* urges each arm 49*b* in a direction generally away from the reorienting assembly 22*b* and the stacks 29i b. A cam assembly 58*b* intermittently urges the arms 49*b* and the tamper frames 51*b* in a direction generally toward the reorienting assembly 22*b* and the product stacks 29*b*. More particularly, the cam assembly 58*b* includes a rotating disk 59*b* and a plurality of generally circumferentially located cam members 62*b* which serially engage the follower 55*b* while the disk 59*b* rotates along with the shaft 38*b*. Set screws 73 may be provided in order to adjust the amplitude of movement of the arms 49*b*. Inasmuch as the reorienting assembly 22*b* and the tamping assembly 24*b* are both mounted onto the shaft 38*b*, both assemblies are driven by a single drive assembly 74.

Figure 9:
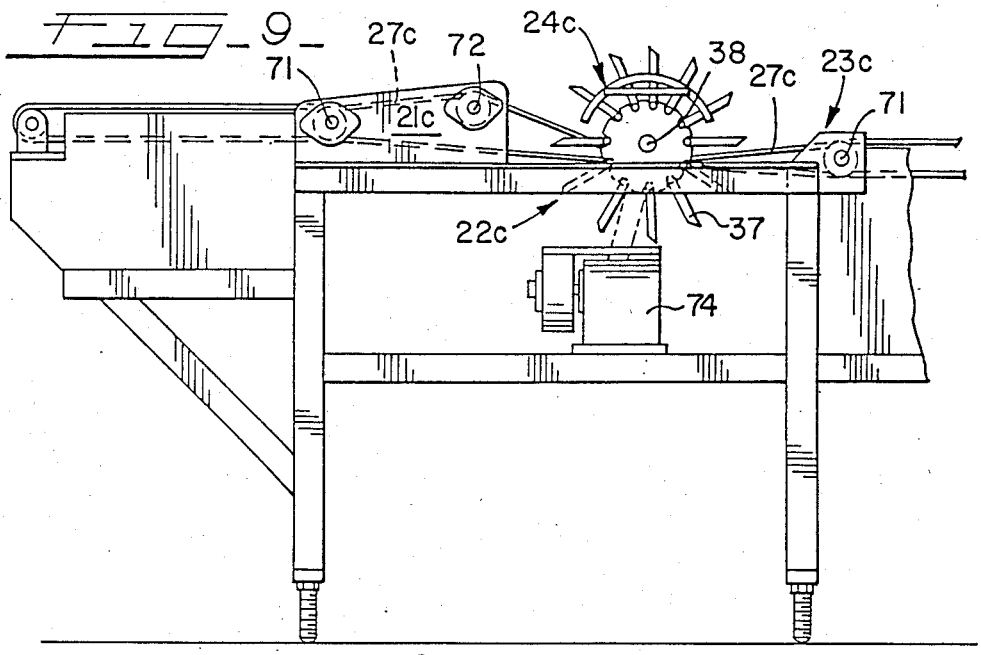
FIG. 9 is an elevational view illustrating a further embodiment of a reorienting and tamping assembly.

With reference to the system illustrated in FIG. 9, this includes an infeed assembly 21*c* and an outfeed assembly 23*c* that are substantially the same as the infeed assembly 21*b* and the outfeed assembly 23*b*, respectively. Such includes a plurality of elongated belts 27*c*that are arranged substantially the same as the belts 27*b*. A tamping assembly 24*c* may also be provided which is similar to the tamping assembly 24*b*.

Referring more particularly to the reorienting assembly 22*c*, such includes a plurality of support tines 37 mounted onto a support shaft 38, which tines 37 are substantially identical to those of the embodiment illustrated in FIGS. 1 through 3. However, reorienting assembly 22*b* includes no longitudinal dimension, the support tines 37 being circumferentially oriented and mounted for rotation through a circumference that is concentric with the rotatable shaft 38.

Figure 10:
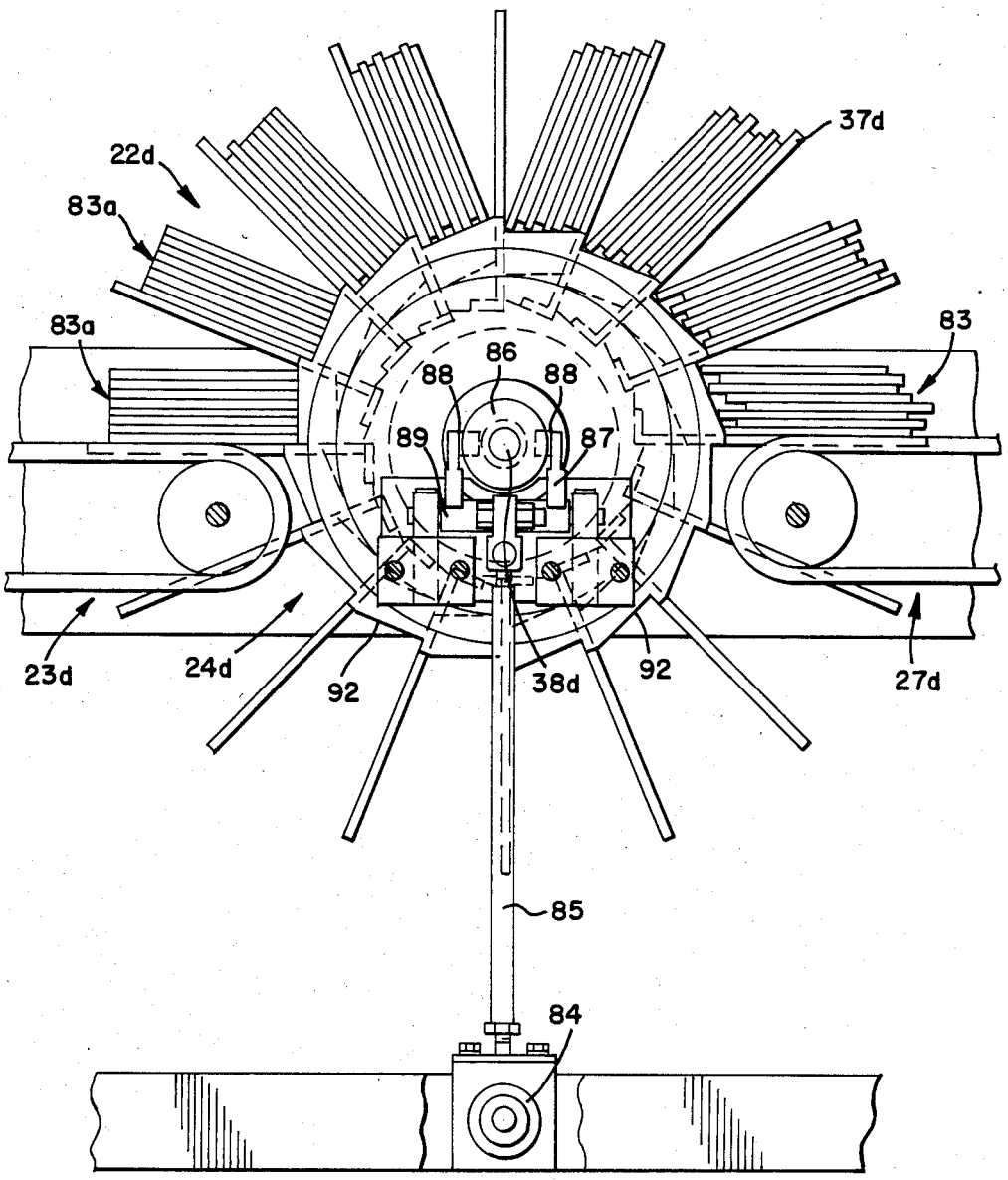
FIG. 10 is an elevational view of a preferred reorienting and shaker assembly.
Figure 11:
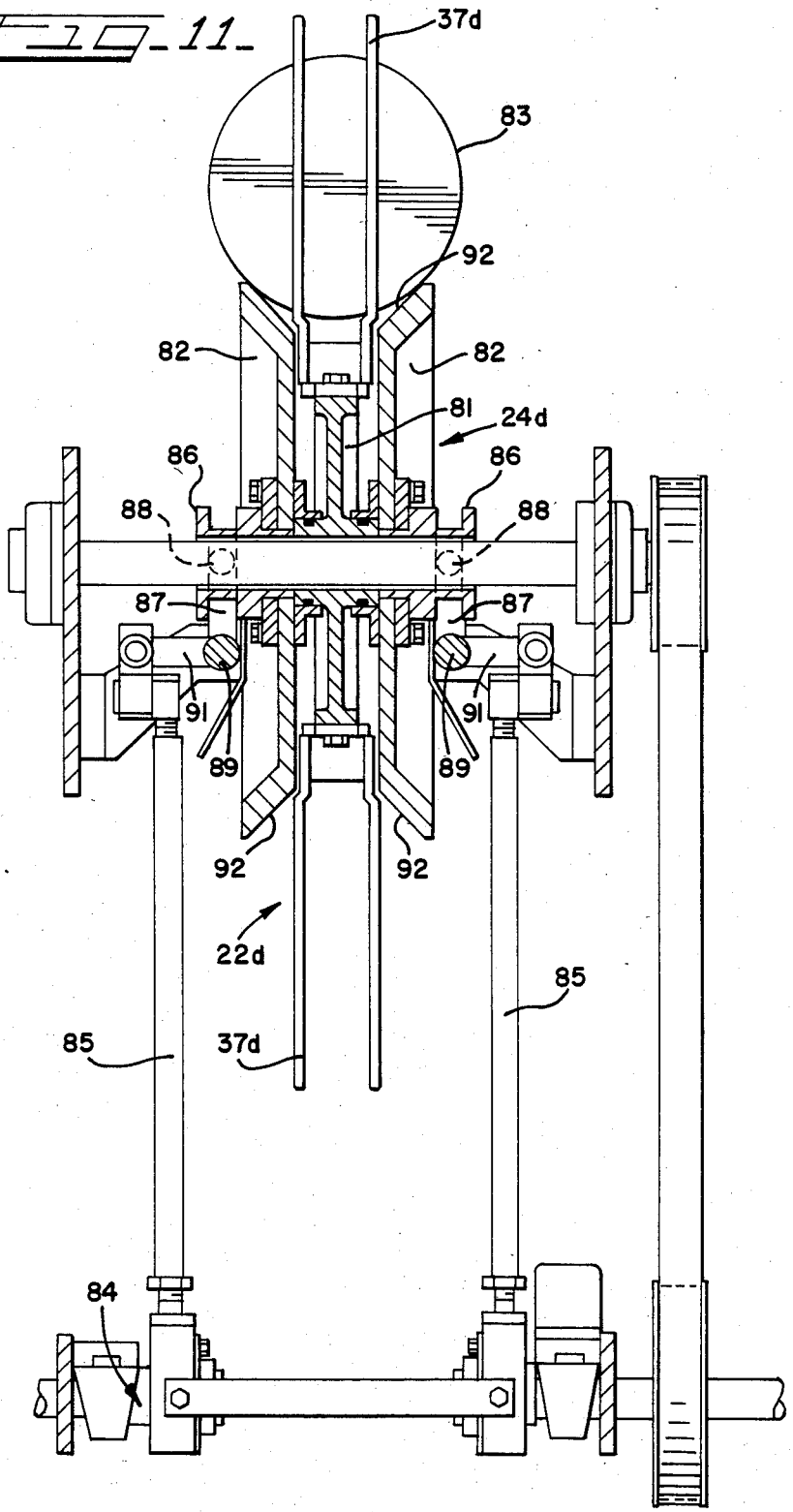
FIG. 11 is a sectional view generally along the rotational axis of the assembly of FIG. 10.

Regarding the system illustrated in FIGS. 10 and 11, such includes an infeed assembly 21*d* and an outfeed assembly 23*d*, typically having a plurality of elongated belts 27*d*. In this embodiment, a reorienting assembly 22*d* and a tamping or shaker assembly 24*d* are mounted onto a rotatable shaft 38*d* and rotate together in response to rotation of the shaft 38*d*, which is indexed when a stack 83 is properly positioned on the infeed assembly 21*d*. Reorienting assembly 22*d* includes a plurality of forks having tines 37*d* that are secured to the shaft 38*d* such as through a fork wheel 81. Tamping or shaker assembly 24*d* includes a pair of shaker wheels 82 that generally flank and rotate with the tines 37*d* and that reciprocate in a direction that is generally parallel to the axis of the shaft 38*d*.

The reciprocating motion of the shaker wheels 82 effectively bounces stacks 83 of product slices to an extent that is sufficient to cause the slices to settle into perfectly formed and aligned stacks 83*a* prior to discharge onto the outfeed assembly 23*d*. Such reciprocation may be effected by the illustrated mechanical assembly that includes an eccentric assembly 84 for reciprocating tie rods 85 which, through a yoke assembly, in turn reciprocate actuators 86 which impart the reciprocating movement to the respective shaker wheels 82. The illustrated yoke assembly includes a yoke 87 having bearings 88 that are received by the respective actuators 86. Each yoke 87 is secured onto a pivot rod 89 to which is secured a lever arm 91 that is mounted to and driven by one of the tie rods 85.

Each shaker wheel 82 has a configuration that assists in achieving slice alignment. Each shaker wheel 82 has a plurality of inclined indents 92 that are spaced throughout the periphery of the shaker wheel 82 at locations that are generally between adjacent tines 37*d*.

More particularly, each inclined indent 92 has a length that spans the circumferential spacing between adjacent tines 37*d* at radial locations that correspond to the peripheral configuration of each shaker wheel 82. Furthermore, as illustrated in FIG. 10, the inclined surface provided by each inclined indent 92 forms a right angle with one pair of its corresponding tines 37*d* so that, within the discharge quadrant of the reorienting assembly 22*c*, each neatened stack 83*a* is supported along its bottom surface and along its height by respective members that are perpendicular to each other.

Inasmuch as this invention can be embodied in various forms, it is to be construed and limited only by the scope of the appended claims.

We claim:

1. An apparatus for neatening uneven stacks of foodstuff slices, comprising:

means for infeeding a flow of a plurality of stacks of generally horizontal oriented foodstuff slices to the apparatus;

reorienting means for receiving and reorienting the stacks of foodstuff slices from said infeeding means, said reorienting means including a plurality of outwardly projecting members that are longitudinally spaced along a rotating reorienting pathway, said longitudinal spacing between the projecting members being adequate to accommodate one of said stacks;

means for rotating said reorienting means and for moving said projecting members along the reorienting pathway from a location of generally horizontal infeed orientation to a location of generally vertical orientation and then to a location of generally horizontal outfeed orientation; tamping means having a reciprocating shaker wheel that moves with the projecting members along said reorienting pathway, said shaker wheel having a surface that supports said stacks along at least a portion of said reorienting pathway; and outfeed means for receiving the stacks of foodstuff from said projecting members at the location of generally horizontal outfeed orientation.

2. The neatening apparatus of claim 1, said tamping means including a pair of reciprocating shaker wheels that generally flank and that move with the projecting members along said reorienting pathway, said shaker wheels each having a generally peripheral surface that supports said stacks along at least a portion of said reorienting pathway.

3. The neatening apparatus of claim 1, said tamping means having an axially reciprocating shaker wheel that has a surface which supports said stacks along at least a portion of said reorienting pathway, said shaker wheel surface having a plurality of indents that are at locations which generally correspond to spacings between adjacent outwardly projecting members.

4. The neatening apparatus of claim 3, wherein each said indent is an inclined indent that has a length which generally spans circumferential spacing between such adjacent outwardly projecting members.

5. The neatening apparatus of claim 3, wherein each said indent has a stack support surface that is substantially perpendicular to one of said outwardly projecting members.

6. A method for neatening uneven stacks of foodstuff slices, comprising:

infeeding a flow of a plurality of uneven stacks of generally horizontally oriented foodstuff slices;

receiving the flow of uneven stacks of infed foodstuff slices between a plurality of longitudinally spaced outwardly projecting members, each uneven stack being received between said spaced projecting members;

reorienting said stacks of infed food slices by rotating said plurality of longitudinally spaced outwardly projecting members along a rotating reorienting pathway, said reorienting step including rotating the plurality of outwardly projecting members and the stacks along the reorienting pathway from a generally horizontal infeed orientation to a generally vertical orientation and then to a generally horizontal outfeed orientation and wherein said reorienting step includes supporting a peripheral edge of the slices with a reciprocating shaker member;

neatening each stack of infed slices during said reorienting step; and outfeeding each neatened stack of foodstuff slices, said outfeeding step being from the generally horizontal outfeed orientation.

* * * * *